US007004146B1

(12) United States Patent
Kato

(10) Patent No.: US 7,004,146 B1
(45) Date of Patent: Feb. 28, 2006

(54) FUEL INJECTION SYSTEM FOR OUTBOARD MOTOR

(75) Inventor: Masahiko Kato, Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 773 days.

(21) Appl. No.: 09/651,051

(22) Filed: Aug. 24, 2000

(30) Foreign Application Priority Data

Aug. 24, 1999 (JP) ..... 11-236461
Aug. 24, 1999 (JP) ..... 11-236462

(51) Int. Cl.
*F02M 37/04* (2006.01)

(52) U.S. Cl. ..... 123/467; 123/494

(58) Field of Classification Search ..... 123/514, 123/467, 456, 516, 457, 494; 417/463
See application file for complete search history.

(56) References Cited

U.S. PATENT DOCUMENTS 3,810,581 A * 5/1974 Rhine et al. ..... 123/467
4,861,238 A * 8/1989 Kamiyama et al. ..... 417/363
4,996,961 A * 3/1991 Usui ..... 123/456
5,575,262 A * 11/1996 Rohde ..... 123/467
5,598,817 A * 2/1997 Igarashi et al. ..... 123/179.17
5,809,974 A * 9/1998 Osakabe ..... 123/494
6,213,096 B1 * 4/2001 Kato et al. ..... 123/456
6,230,684 B1 * 5/2001 Furuhashi et al. ..... 123/467
6,318,329 B1 * 11/2001 Sato ..... 123/192.1
6,431,149 B1 * 8/2002 Schwegler et al. ..... 123/467

FOREIGN PATENT DOCUMENTS

JP 11-270426 10/1999
JP 11-270427 10/1999
JP 11-270430 10/1999

* cited by examiner

*Primary Examiner*—Carl S. Miller
(74) *Attorney, Agent, or Firm*—Knobbe Martens Olson and Bear, LLP

(57) ABSTRACT

An engine of an outboard motor includes a fuel injection system that is configured to increase the accuracy of fuel pressure measurements and more precisely control the amount of fuel injected. In a preferred mode, the fuel injection system can include a pressure dampening device that is connected to the direct fuel injected system. The system can also include a vibration dampening apparatus that protects a pressure sensor from damage that can be caused by engine vibrations.

21 Claims, 10 Drawing Sheets

FUEL INJECTION SYSTEM FOR OUTBOARD MOTOR

PRIORITY INFORMATION

The present application is based on and claims priority to Japanese Patent Application No. 11-236461, filed Aug. 24, 1999, and Japanese Patent Application No. 11-236462, filed Aug. 24, 1999. The entire contents of these applications are hereby expressly incorporated by reference.

BACKGROUND OF THE INVENTION

1. Field of the Invention

This invention relates to a fuel supply system for a direct fuel injected engine. More particularly, the present invention relates to an improved fuel supply system that is most suitable for direct fuel injected engines used outboard motors.

2. Related Art

In all fields of engine design, there is a demand for obtaining more effective emission control and better fuel economy while at the same time increasing power output. To meet this demand, fuel injection systems have replaced carburetors as the engine charge former. In such systems, fuel is typically injected into an intake air manifold. In order to achieve even better performance, direct fuel injections systems have been developed. These systems inject fuel directly into the combustion chamber through a fuel injector. The principal advantage of direct fuel injection systems is that mixing of the fuel and the air within the combustion chamber can be precisely controlled.

To further improve performance, direct fuel injection engines typically include an air/fuel ratio sensor for detecting the air/fuel ratio in the combusted exhaust gases. This information is used by an engine control system to adjust the amount of fuel injected into the combustion chamber. In a fuel injected engine, the amount of fuel being injected into the engine is typically calculated from the fuel pressure at the fuel injectors and the duration that the fuel injectors are opened. Accordingly, fuel injected engines often include a fuel pressure sensor for calculating the amount of fuel injected into the combustion chamber.

There are several problems associated with calculating the fuel pressure. For example, because direct fuel injection engines typically require a high fuel pressure, the fuel pipes of the fuel system are typically made of metal. Pressure pulsations caused by a fuel pump are amplified by these metal components. This reduces the accuracy of the fuel pressure measurement, which can result in an inaccurate amount of fuel being injected into the combustion chamber. This can impair the emissions, fuel economy and power of the engine.

The pressure fluctuations in the fuel system can be reduced, to an extent, by a pressure regulator. However, the fuel injectors are often located downstream from the pressure regulator. For example, in outboard motors, the crank shaft is disposed vertically. Typically, fuel is supplied to the fuel injectors through fuel rails, which extend vertically from a high pressure fuel pump located above the fuel injectors. The pressure regulator typically is also located above the fuel injectors. With this arrangement, the pressure regulator is located a significant distance from the fuel injectors. Accordingly, pressure fluctuations at the fuel injectors are particularly large especially for the fuel injectors located at the end of the fuel rail farthest from the pressure regulator.

Another problem associated with calculating fuel pressure is that the fuel pressure sensors themselves often produce inaccurate measurements. Fuel pressure sensors typically include fine distortion gauges and circuits that are easily damaged, especially by excessive vibration. However, the fuel pressure sensors are typically directly attached to the fuel system, which is mostly made of metal components that effectively transmit the vibrations produced by the engine. Accordingly, it is difficult to prevent the fuel pressure sensor from being damaged by the engine vibrations. This can also result in an inaccurate amount of fuel being injected into the combustion chamber.

SUMMARY OF THE INVENTION

One aspect of the present invention is the recognition that the bottom of a fuel rail reflects pressure pulsations. It is further recognized that inserting a pulsation damper at the end of the fuel rail significantly reduces the pressure pulsation at the fuel injectors. This is especially true for the fuel injectors located near the end of the fuel rail because they typically experience the greatest amount of fuel pulsation.

In accordance with another aspect of the invention, a direct fuel injected system for an internal combustion engine with at least one combustion chamber includes a high pressure fuel pump for developing high pressure fuel. The system further includes a fuel injector to directly inject fuel into the combustion chamber of the engine. The fuel injector receives high pressure fuel from the fuel pump. The system also includes a pressure dampening device that is in communication with the fuel injector.

In accordance with yet another aspect of the invention, a direct fuel injected system for an internal combustion engine having at least one combustion chamber includes a high pressure fuel pump for developing high pressure fuel. The system also includes a fuel injector to directly inject fuel into the combustion chamber of the engine and a pressure regulator to regulate fuel pressure within the fuel system. The system further including a fuel pressure sensor for sensing a fuel pressure of the fuel. The fuel pressure sensor being secured to the engine through a vibration damping apparatus.

In accordance with still yet another aspect of the invention, a direct fuel injected system for an internal combustion engine comprising a high pressure fuel pump for developing high pressure fuel and a fuel injector to directly inject fuel into a combustion chamber of the engine. The fuel system further including a fuel pressure sensor that communicates with the fuel system for measuring a fuel pressure. The system also including means for protecting the fuel pressure sensor from damage caused by engine vibrations.

In accordance with another aspect of the invention, a direct fuel injected system for an internal combustion engine includes a high pressure fuel pump for developing high pressure fuel and a fuel injector to directly injector fuel into a combustion chamber of the engine. The system also including a fuel pressure sensor that communicates with said fuel system for measuring a fuel pressure within the fuel system. The system also including means for reducing fuel pressure fluctuations within the fuel system.

Finally, in accordance with another aspect of the invention, a direct fuel injected system for an internal combustion engine having at least one combustion chamber includes a high pressure fuel pump for developing high pressure fuel. The system also includes a fuel injector to directly inject fuel into the combustion chamber of the engine. The fuel injector receives high pressure fuel from the fuel pump. The system further including a fuel pressure sensor for sensing a fuel pressure of the fuel. The fuel pressure sensor is secured to said engine through a vibration damping apparatus. The system also includes a pressure dampening device in communication with the fuel injector.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

These and other features, aspects and advantages of the present invention will now be described with reference to the drawings of several preferred embodiments, which embodiments are intended to illustrate and not to limit the present invention, and in which drawings.

DETAILED DESCRIPTION OF THE PREFERRED EMBODIMENTS OF THE INVENTION

Figure 1:
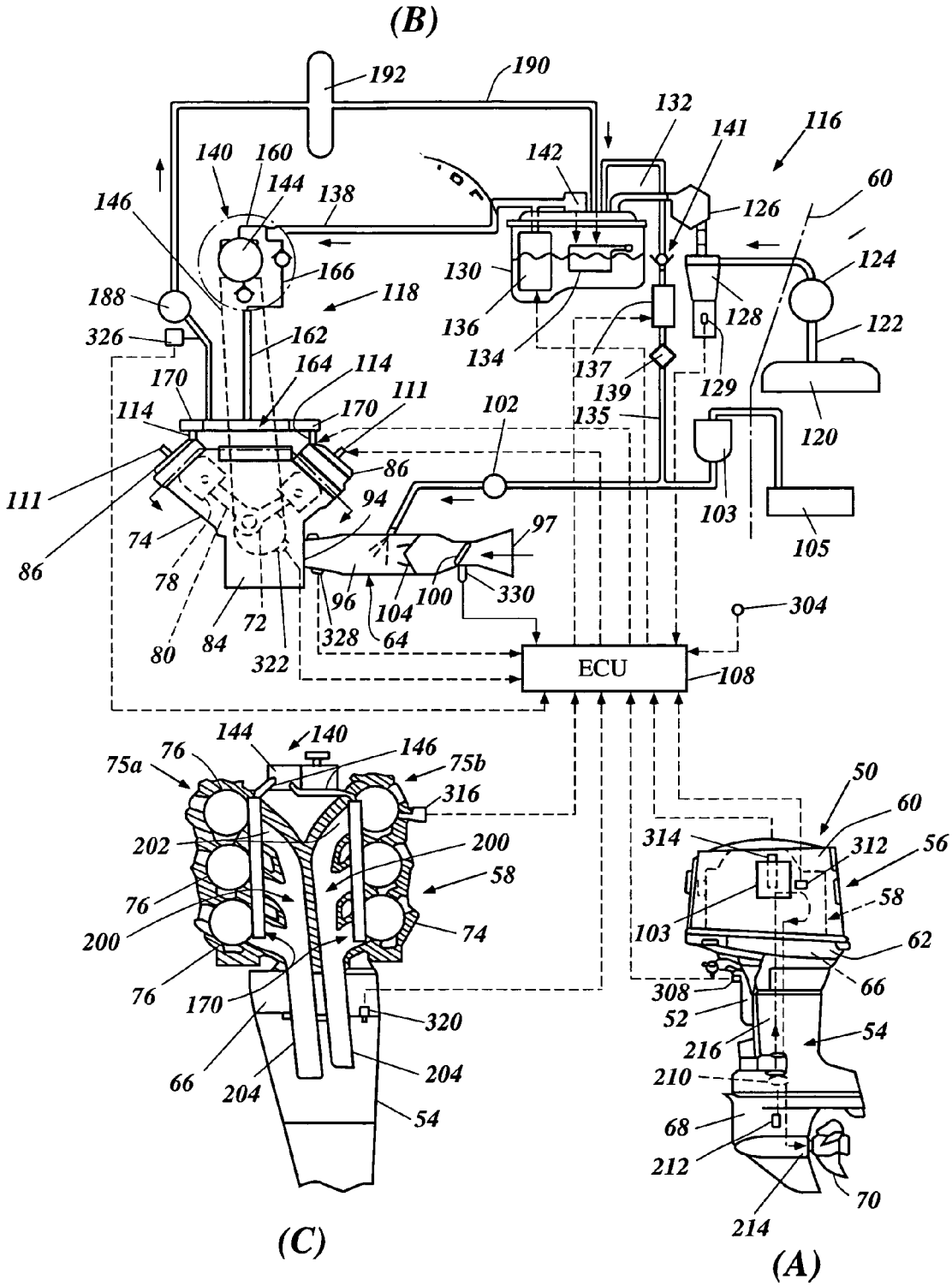
FIG. 1 is a multi-part view showing: (A) in the lower right hand portion, a side elevation view of an outboard motor employing certain features, aspects and advantages of the present invention; (B) in the upper view, a partially schematic view of the engine of the outboard motor with its induction and fuel injection system shown in part schematically; and (C) in the lower left hand portion, a rear elevation view of the outboard motor with portions removed and other portions broken away and shown in section along the line C—C in the upper view B so as to more clearly show the construction of the engine. An ECU (electric control unit) for the motor links the three views together.

With reference now to FIG. 1, an outboard motor with a fuel supply system having certain features, aspects and advantages of the present invention will be described. While the present invention will be described in the context of the outboard motor, it is anticipated that the present fuel supply system can have utility in other environments of use. For instance, the fuel supply system can be used in any vehicular application featuring a fuel supply system, such as automotive and marine applications. Moreover, the present fuel supply system can also be used in stationary engines, such as those found on generators, for instance.

In the lower right hand view of FIG. 1 (i.e., FIG. 1(A)), the outboard motor is depicted in side elevation view and is identified generally by the reference numeral 50. The outboard motor 50 preferably includes a clamping arrangement 52. The clamping arrangement 52 is used to attach the outboard motor 50 to the hull of the watercraft (not shown) in any suitable manner. The outboard motor 50 preferably is connected to the hull of the watercraft such that it may be steered about a generally vertical axis and tilted or trimmed about a generally horizontal axis.

The outboard motor 50 generally comprises a drive shaft housing 54 and a powerhead 56, which is positioned generally above, and generally is supported by, the drive shaft housing 54. The powerhead 56 preferably includes a powering internal combustion engine, which is indicated generally by the reference numeral 58. The engine 58 also is shown in the remaining two views of FIG. 1 (i.e., FIGS. 1(B) and 1(C)) and, therefore, will be described in more detail below with reference to these portions of FIG. 1.

The illustrated powerhead 56 generally includes a protective cowling which comprises a main cowling portion 60 and a lower tray portion 62. The main cowling portion 60 preferably includes a suitable air inlet arrangement (not shown) to introduce atmospheric air into the interior of the protective cowling. The air present within the protective cowling then can be drafted into an engine intake system or induction system, which is generally indicated by the reference numeral 64 (see FIG. 1(B)) and which will be described in greater detail directly below.

The main cowling portion 60 preferably is detachably connected to the lower tray portion 62 of the powerhead 56. The detachable connection preferably is generally positioned proximate an exhaust guide plate 66. The exhaust guide plate 66 is encircled by an upper portion of the drive shaft housing 54 and forms a portion of an exhaust system, which will be described below. Positioned beneath the illustrated drive shaft housing 54 is a lower unit 68 in which a propeller 70 is journaled for rotation. As these constructions are well known to those of ordinary skill in the art, further description of these components is unnecessary.

As is typical with outboard motor practice, the illustrated engine 58 is supported in the powerhead 56 so that a crankshaft 72 (see FIG. 1(B)) can rotate about a generally vertically extending axis. FIG. 1(B) schematically illustrates the engine from a top view. The vertical mounting of the crankshaft 72 facilitates the connection of the crankshaft 72 to a driveshaft (not shown) that depends into and through the driveshaft housing 54. The driveshaft drives the propeller 70 through a forward, neutral and reverse transmission (not shown) contained in the lower unit 68. Of course, other suitable types of transmissions also can be used with certain features, aspects and advantages of the present invention.

With reference now to FIG. 1(C), the illustrated engine 58 is of the V6 type and operates on a 2-stroke crankcase compression principle. It is anticipated that the present fuel supply system can also can be utilized with engines having other cylinder numbers and other cylinder configurations. For instance, the cylinders can be arranged in-line in some arrangements, and the engine can comprise as few as one or more than eight cylinders in various other arrangements. Moreover, certain features of the present fuel injector mounting arrangement also may find utility with engines operating on other operating principles, such as a rotary principle or a four-cycle principle. With reference now to FIGS. 1(B) and 1(C), the illustrated engine 58 is generally comprised of a cylinder block 74 that is formed with a pair of cylinder banks 75*a,b*. Each of these cylinder banks 75*a, b* preferably is formed with three vertically-spaced, horizontally-extending cylinder bores 76 (see FIG. 1(C)). In some arrangements, separate cylinder bodies for each cylinder bore can be used in place of the single cylinder block. For instance, each cylinder body may accommodate but a single cylinder bore and a number of cylinder bodies can be aligned side by side yet be formed separate from one another.

A set of corresponding pistons 78 preferably are arranged and configured to reciprocate within the cylinder bores 76. The illustrated pistons 78 are connected to the small ends of connecting rods 80. The big ends of the connecting rods 80 preferably are journaled about the throws of the crankshaft 72 in a well known manner.

With continued reference to FIG. 1(B), the illustrated crankshaft 72 is journaled in any suitable manner for rotation within a crankcase chamber (not shown). Desirably, the crankcase chamber (not shown) is formed, at least in part, by a crankcase member 84 that may be connected to the cylinder block 74 or the cylinder bodies in any suitable manner. As is typical with 2-stroke engines, the illustrated crankshaft 72 and the crankcase chamber (not shown) preferably are formed with dividing seals or dividing walls such that each section of the crankcase chamber (not shown) associated with one of the cylinder bores 76 can be sealed from the other sections that are associated with other cylinder bores. This type of construction is well known to those of ordinary skill in the art.

With reference to FIG. 1(B), a cylinder head assembly, indicated generally by the reference numeral 86, preferably is connected to an end of each of the cylinder banks that is spaced from the crankcase member 84. Each cylinder head assembly 86 generally is comprised of a main cylinder head member and a cylinder head cover member, which are not shown. The cylinder head cover member is attached to the cylinder head member in any suitable manner. As is known, the cylinder head member preferably includes a recess that corresponds with each of the cylinder bores 76. As will be appreciated, each of the recesses cooperates with a respective cylinder bore 76 and a head of a reciprocating piston 78 to define a variable volume combustion chamber.

With reference again to FIG. 1(B), the air induction system 64 is provided for delivering an air charge to the sections of the crankcase chamber (not shown) associated with each of the cylinder bores 76. In the illustrated arrangement, communication between the sections of the crankcase chamber and the air contained within the cowling occurs at least in part via an intake port 94 formed in the crankcase member 84. The intake port 94 can register with a crankcase chamber section corresponding to each of the cylinder bores 76 such that air can be supplied independently to each of the crankcase chamber sections. Of course, other arrangements are also possible.

The induction system 64 also includes an air silencing and inlet device, which is shown schematically in FIG. 1(B), indicated generally by the reference numeral 96. In one arrangement, the device 96 is contained within the cowling member 60 at the cowling's forward end and has a rearwardly-facing air inlet opening (not shown) through which air is introduced into the silencer 96. Air can be drawn into the silencer 96 from within the cowling 60 via an inlet opening 97.

The air inlet device 96 supplies the induced air to a plurality of throttle bodies, or induction devices, 100. Each of the throttle bodies 100 preferably has a throttle valve provided therein. The illustrated throttle valves are desirably supported on throttle valve shafts that are linked to each other for simultaneous opening and closing of the throttle valves in a manner that is well known to those of ordinary skill in the art. It is anticipated, however, that a single supply passage can extend to more than one or even all of the chambers such that the number of throttle valves can be one or more than one depending upon the application.

A lubricant pump 102 preferably is provided for spraying lubricant into the air inlet device 96 for lubricating moving components of the engine 58 in manners well known to those of ordinary skill in the art. In addition, a small amount of lubricant also can be introduced into the fuel prior to introduction to a fuel injector system that will be described in a manner that also will be described. Preferably, the lubricant pump 102 is controlled by an ECU 108, which also will be described in more detail later.

The lubricant pump 102 in the illustrated arrangement draws lubricant from a primary lubricant supply tank 103. In addition, in the illustrated arrangement, lubricant is supplied to the primary lubricant supply tank 103 from an auxiliary tank 105. Other arrangements also can be used.

As is typical in 2-cycle engine practice, the illustrated intake ports 94 include reed-type check valves 104. The check valves 104 permit inducted air to flow into the sections of the crankcase chamber when the pistons 78 are moving upwardly in their respective cylinder bores 76. The reed-type check valves 104, however, do not permit back flow of the air. Therefore, as the pistons 78 move downwardly within the respective cylinder bores 76, the air charge will be compressed in the sections of the crankcase chamber. As is known, the air charge is then delivered into the associated combustion chamber through suitable scavenge passages (not shown). This construction is well known to those of ordinary skill in the art.

A spark plug 111 is mounted within the cylinder head 86 and has an electrode disposed within the combustion chamber. The spark plug 111 is fired under the control of the ECU 108 in any suitable manner. For instance, the ECU 108 may use a CDI system to control ignition timing according to any of a number of suitable control routines. The spark plug 111 ignites an air-fuel charge that is formed by mixing the fuel directly with the air inducted into the combustion chamber.

The fuel is preferably provided via respective fuel injectors 114. The fuel injectors 114 preferably are of the solenoid type and preferably are electronically or electrically operated under the control of the ECU 108. The control of the fuel injectors 114 can include the timing of the fuel injector injection cycle, the duration of the injection cycle, and other operating parameters of the fuel injector 114.

With reference again to FIG. 1(B), fuel is supplied to the fuel injectors 114 by a fuel supply system that features a low pressure portion 116 and a high pressure portion 118. The low pressure portion 116 includes a main fuel supply tank 120 that can be provided in the hull of the watercraft with which the outboard motor 50 is associated. The preferred location of the main fuel supply tank 120 and the main lubricant reservoir 105 exterior to the outboard motor is demonstrated in FIG. 1(B) through the use of phantom lines. Fuel can be drawn from the main tank 120 through a supply conduit 122 using a first low pressure pump 124. In some arrangements, a plurality of secondary low pressure pumps 126 also can be used to draw the fuel from the fuel tank 120. The pumps can be manually operated pumps, diaphragm-type pumps operated by variations in pressure in the sections of the crankcase chamber, or any other suitable type of pump. Preferably, the pumps 124, 126 provide a relatively low pressure draw on the fuel supply.

In addition, in the illustrated arrangement, a fuel filter 128 is positioned along the conduit 122 at an appropriate location within the main cowling 60 such that the fuel filter may be easily serviced. The fuel filter in the illustrated arrangement is used to remove undesirable amounts of water from the fuel. Therefore, the fuel filter 128 includes a sensor 129 that sends a signal to the ECU 108 upon a detection of such water or upon a preset amount of water having been removed from the fuel.

From the illustrated secondary low pressure pump 126, the fuel is supplied to a low pressure vapor separator 130. The vapor separator 130 can be mounted on the engine 58 in any suitable location. In addition, in some arrangements, the vapor separator 130 is separate from the engine, but positioned within the cowling portion 60 at an appropriate location. The fuel is supplied to the vapor separator 130 through a supply line 132. At the vapor separator end of the supply line 132, there preferably is provided a valve which is not shown that can be operated by a float 134 so as to maintain a substantially uniform level of fuel in the vapor separator tank 130.

As described above, the fuel supply preferably receives a small amount of lubricant from the lubricant system at a location upstream of the fuel injectors 114. In the illustrated arrangement, the vapor separator tank 130 receives a small amount of lubricant from the lubricant system through a supply conduit 135. A premixing pump 137 draws the lubricant through the supply conduit 135 that empties into the vapor separator tank 130. A filter 139 and a check valve 141 preferably are provided along the conduit 135. The filter 139 removes unwanted particulate matter and/or water while the check valve 141 reduces or eliminates back-flow through the supply conduit 135. Notably, the premixing pump 137 preferably is controlled by the ECU 108. This control can be at least partially dependent upon the flow of fuel and the flow of return fuel into the vapor separator tank 130.

A fuel pump 136 can be provided in the vapor separator 130 and can be controlled by ECU 108 in any suitable manner. In the illustrated arrangement, the connection between the ECU 108 and the fuel pump 136 is schematically illustrated. While the schematic illustration shows a hard-wired connection, those of ordinary skill in the art will appreciate that other electrical connections, such as infrared radio waves and the like can be used. This description of the connection between the ECU 108 and the fuel pump 136 also applies to a variety of other components that also are connected to the ECU 108.

The fuel pump 136 preferably pre-pressurizes the fuel that is delivered through a fuel supply line 138 to a high pressure pumping apparatus 140 of the high pressure portion 118 of the fuel supply system. The fuel pump 136, which can be driven by an electric motor in some arrangements, preferably develops a pressure of about 3–10 kg per $cm^2$. A low pressure regulator 142 can be positioned along the line 138 proximate the vapor separator 130 to limit the pressure of the fuel that is delivered to the high pressure pumping apparatus 140 by dumping some portion of the fuel back into the vapor separator 130.

Figure 2:
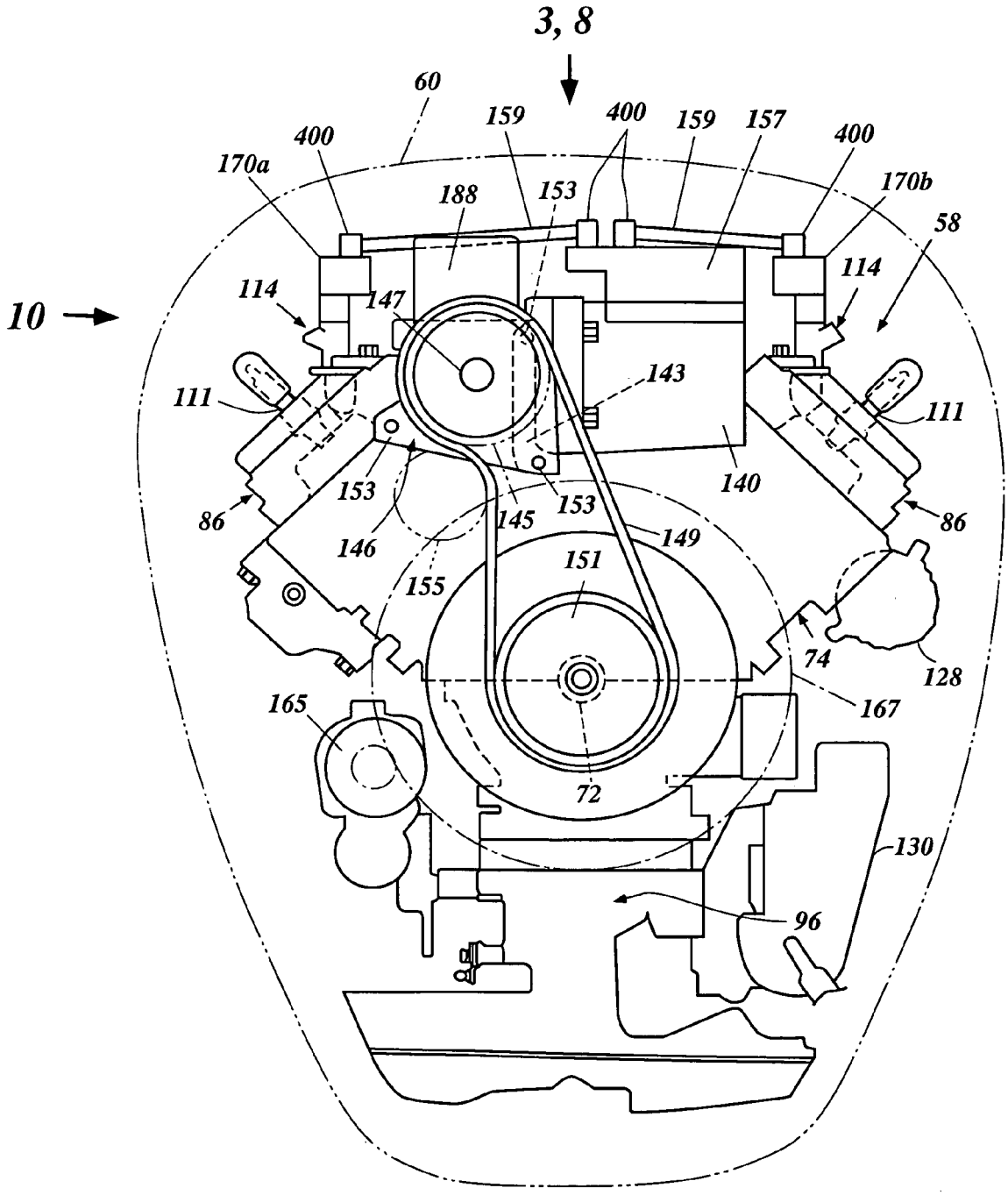
FIG. 2 is a simplified top plan view of the power head of FIG. 1 of a motor showing the engine in solid lines and the protective cowling in phantom.

The illustrated high pressure fuel delivery apparatus 140 includes a high pressure fuel pump 144 that can develop a pressure of, for example, 50–100 kg per $cm^2$ or more. A pump drive unit 146 (see also FIG. 1(C)) preferably is provided for driving the high pressure fuel pump 144. With reference to FIG. 2, the pump drive unit 146 is partly affixed to the cylinder block 74 via a mounting plate 143 with bolts 153 so as to overhang between the two banks of the V arrangements. A pulley 145 (FIG. 2) is affixed to a pump drive shaft 147 of the pump drive unit 146. The pulley 145 is driven by means of a drive belt 149 wrapped that is wrapped about a driving pulley 151 affixed to the crankshaft 72. A tensioner 155 is preferably provided for giving tension to the drive belt 149. The pump drive shaft 147 is preferably provided with a cam disc (not shown) for operating one or more plungers (not shown) of any known type. Of course, any other suitable driving arrangement can also be used.

Figure 3:
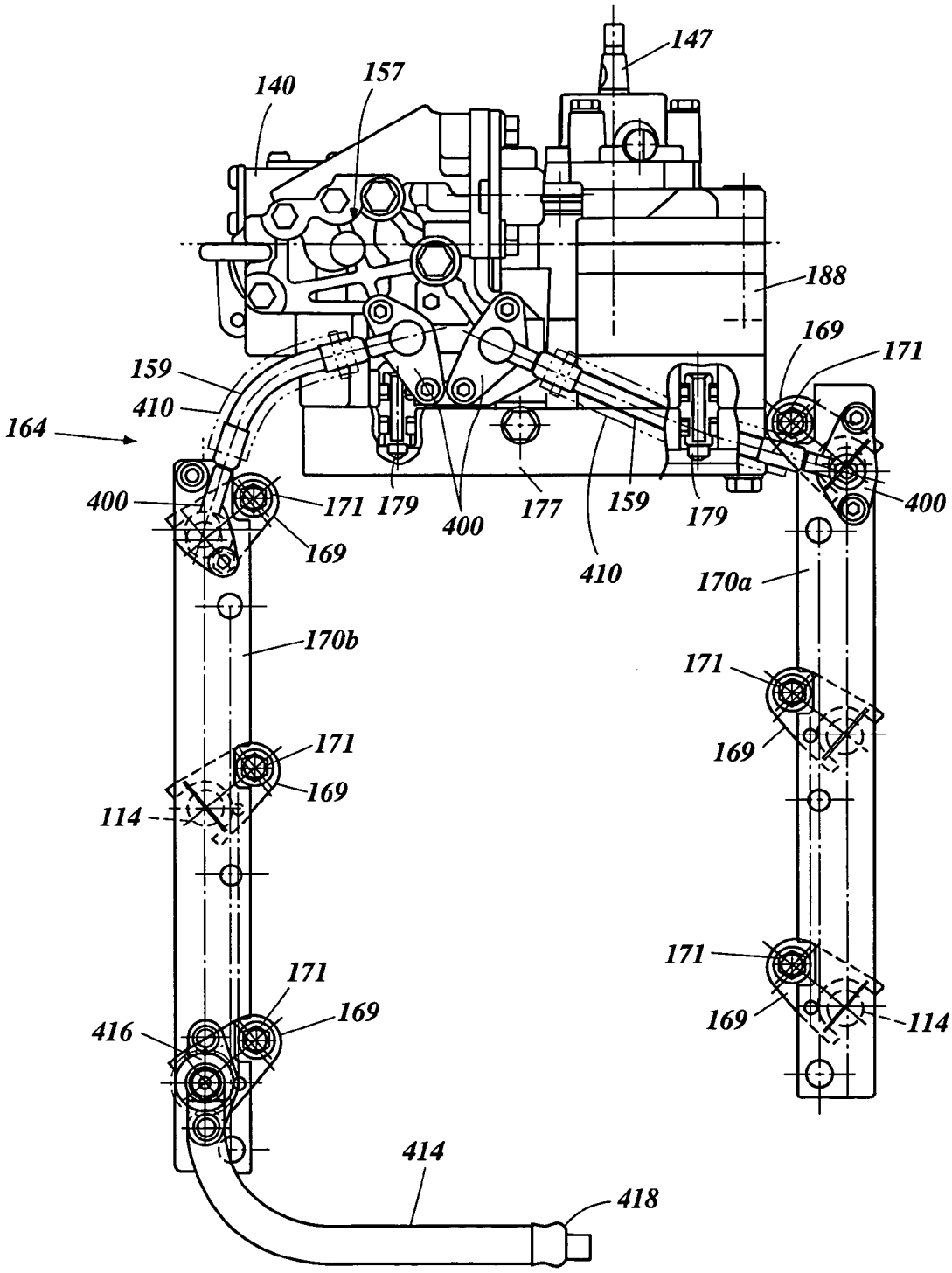
FIG. 3 is a rear elevational view taken generally in the direction indicated by arrow 3 in FIG. 2 showing a high pressure fuel injection assembly of the engine.

With reference to FIG. 1(B) and FIG. 3, the high pressure fuel pump 144 preferably includes a fuel inlet and outlet module 157. The inlet and outlet module 157 can include an inlet passage 160 connected with the line 138 and an outlet high pressure passage 162 that is connected with a fuel injector supply system indicated generally at 164. The module also can include a bypass passage 166 that bypasses the fuel pump and is connected between the low pressure side of the high pressure fuel pump 144 and the outlet high pressure passage 162. Fuel can be supplied from the high pressure pump 144 to the fuel injector supply system 164 through the high pressure passage 162 or can be bypassed through the bypass passage 166.

Figure 4:
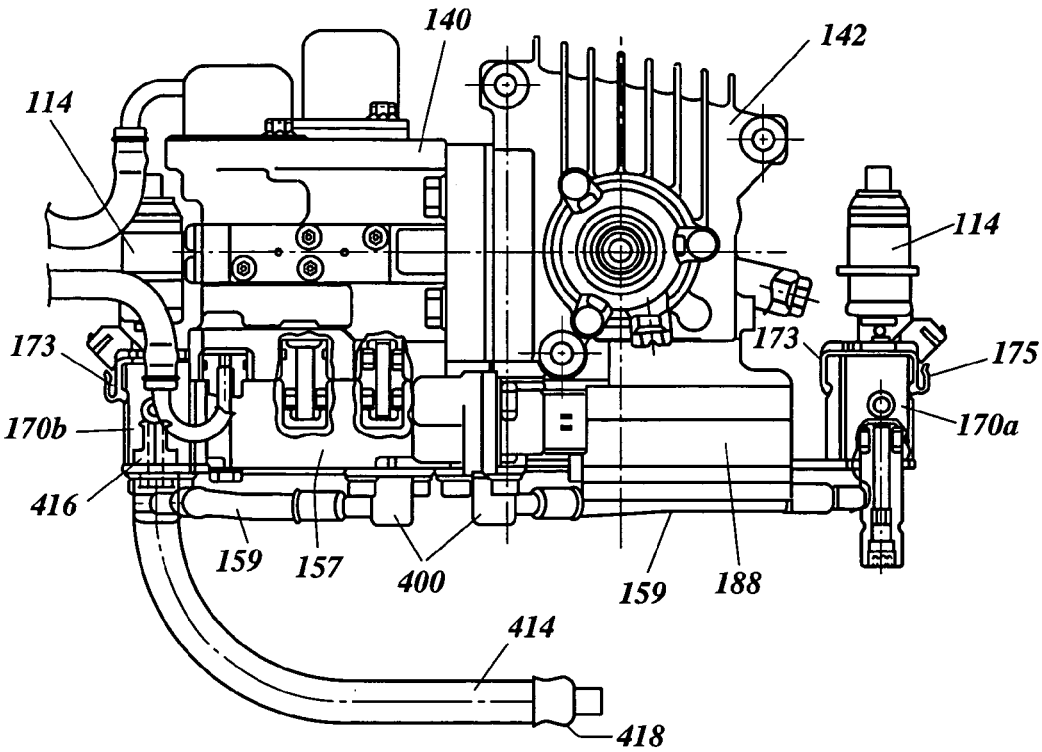
FIG. 4 is top plan view of the of the high pressure fuel injection system in the same arrangement as FIG. 3.

With reference to FIGS. 1(C), 3 and 4, the fuel injector supply system 164, preferably include a pair of generally vertically-extending fuel rails 170*a,b*, which deliver fuel to the fuel injectors 114. The fuel rails 170*a,b* preferably are disposed along the cylinder banks 75*a,b*. Accordingly, the fuel rails 170*a,b* are preferably disposed in a generally vertical direction and are secured to the cylinder head assembly 86 by bolts (not shown). The fuel injectors 114, in turn are secured to the cylinder head assembly 86 by fixtures 169 and bolts 171. The fuel injectors 114 are further secured and positioned with openings (not shown) in the fuel rail 170*a,b* by clips 173. The clips 173 preferably include integrally formed handles 175, which can be used to secure the electrical wires that connect the fuel injectors 114 to the ECU.

The fuel rails 170*a,b* are preferably connected to the high pressure passage 162 by a pair of pressure damping conduits 159 having certain features and advantages according to the present invention. The pressure damping conduits 159 and their function will be described in more detail below.

With reference back to FIG. 1(B), in the illustrated arrangement, pressure of the fuel supplied by the fuel pump 144 to the fuel injectors 114 is regulated to a generally fixed value by a high pressure regulator 188. The illustrated pressure regulator 188 is mounted on the pump drive unit 146 with bolts (not shown). The pressure regulator 188 is preferably connected to the high pressure supply passage 162 which extends through a lower member 177 that is connected to the fuel inlet and outlet module 157 and the pressure regulator 188 by connectors 179. The high pressure regulator 188 preferably dumps fuel back to the vapor separator 130 through a pressure relief line 190 in which a fuel heat exchanger or cooler 192 is provided. Generally, the fuel is desirably kept under constant or substantially constant pressure so that the volume of injected fuel can be at least partially determined by changes of duration of injection under the condition that the pressure for injection is always approximately the same.

As discussed above, the air delivered by the induction system receives the charge of fuel within the combustion chamber and the air/fuel charge is ignited by the ignition system at an appropriate time. After the charge is ignited, the charge burns and expands such that the pistons 78 are driven downwardly in the respective cylinder bores 76 until the pistons 78 reach a lower-most position. During the downward movement of the pistons 78, the exhaust ports (not shown) are uncovered by the piston 78 to allow communication between the combustion chamber 110 and an exhaust system.

With reference to FIG. 1(C), the illustrated exhaust system features an exhaust manifold section 200 for each of the cylinder banks. A plurality of runners 202 extend from the cylinder bore 76 into the manifold collectors 200. The exhaust gases flow through the branch pipes 202 into the manifold collector section 200 of the respective exhaust manifolds that are formed within the cylinder block in the illustrated arrangement. The exhaust manifold collector sections 200 then communicate with exhaust passages formed in exhaust guide plate 66 on which the engine 58 is mounted.

A pair of exhaust pipes 204 depend from the exhaust guide plate 66 and extend the exhaust passages into an expansion chamber (not shown) formed within the drive shaft housing 54. From this expansion chamber, the exhaust gases are discharged to the atmosphere through a suitable exhaust outlet. As is well known in the outboard motor practice, the suitable exhaust outlet may include an under water, high speed exhaust gas discharge and an above the water, low speed exhaust gas discharge. Because these types of systems are well known to those of ordinary skill in the art, a further description of them is not believed to be necessary to permit those of ordinary skill in the art to practice the present invention.

The illustrated outboard motor 50 also comprises a water cooling system. With reference to FIG. 1(A), the cooling system generally comprises a water pump 210, a pick-up 212 and a discharge 214. The water pump 210 preferably is driven by the rotary motion of the crankshaft 72 and, in some applications, can be driven by the drive shaft. Water is pulled from the body of water in which the watercraft is operating through a pick-up 212. The water then is delivered to the engine 58 through suitable piping and conduits. In the engine, the water can circulate through various water jackets prior to being exhausted through the discharge 214. The discharge 214 can be associated with the exhaust system or can be separate of the exhaust system.

With reference to FIG. 2, the outboard motor 50 also preferably includes a starter 165 and flywheel 167. These components of the outboard motor 50 are well known in the art; thus, a description is not deemed to be necessary.

As indicated above, the ECU 108 samples a variety of data for use in performing any of a number of control strategies. Because some of these control strategies are outside the scope of the present invention, they will not be discussed However, a variety of the sensors from which data is input will be introduced.

With reference to FIGS. 1(A) and 1(B), the ECU 108 receives an input from an atmospheric pressure sensor 304. The atmospheric pressure sensor 304 inputs a value corresponding to the atmospheric pressure in which the watercraft is operating. In addition, the ECU 108 receives a signal from a trim angle sensor 308. As is known, the trim angle sensor 308 sends a signal to the ECU 108 that is indicative of the tilt or trim angle of the outboard motor 50 relative to the watercraft on which the outboard motor 50 is mounted.

With particular reference to FIG. 1(A), the outboard motor 50 also features a coolant temperature sensor 312. The coolant temperature sensor 312 preferable indicates the temperature of the coolant being circulated through the engine 58. The ECU 108 also receives an input from a lubricant level sensor 314. The lubricant level sensor 314 outputs a signal to the ECU 108 indicative of a fill state of the main lubricant reservoir 103.

With reference now to FIG. 1(C), the engine 58 also includes an oxygen sensor 316. The oxygen sensor 316 outputs a signal to the ECU 108 representative of the oxygen content within the exhaust gas flow. As is known to those of ordinary skill in the art, the content of oxygen within the exhaust flow can be used to determine how complete the combustion occurring within the combustion chamber 110 actually is. Moreover, the engine 58 includes a back pressure sensor 320 positioned along the exhaust system to indicate the back pressure being developed within the exhaust system of the engine 58. As will be recognized by those of ordinary skill in the art, the back pressure developed within the exhaust system can vary depending upon the depth of the underwater discharge and whether the above water discharge becomes submerged.

With reference now to FIG. 1(B), the engine also features at least one sensor to determine the engine operating speed and the specific cylinder being fired at any particular time. In the illustrated arrangement, the engine includes a crankshaft speed sensor 322 which outputs a signal to the ECU 108 indicative of a rotational speed of the crankshaft. As is known, the rotational speed of the crankshaft 322 corresponds to the engine speed. In addition, the engine 58 can include a cylinder identification sensor. The cylinder identification sensor transmits a signal to the ECU 108 that indicates which cylinder is being fired at what time during operation of the engine 58. As will be recognized by those of ordinary skill in the art, in some applications, a single sensor or multiple sensors can be used to both indicate which cylinder is operating as well as the engine speed.

The fuel supply system also includes a fuel pressure sensor 326. The fuel pressure sensor 326 preferably is positioned between the high pressure pumping apparatus 140 and the pressure regulator 188. The pressure sensor 326 provides a signal to the ECU 108 which is indicative of the pressure within the fuel supply system. The pressure of the fuel is used to calculate the amount of fuel injected through the fuel injectors 114.

The air induction system also includes a sensor 328 that outputs a signal to the ECU 108 which is indicative of an air temperature within the induction system. The induction system also can include a sensor 330 that emits a signal indicative of a throttle opening angle. This signal can also be used to determine the speed of change of the throttle angle.

While the control system generally comprises the ECU 108 and the above listed sensors which sense various operating conditions for the engine, as well as ambient conditions and/or conditions of the outboard motor that may affect general engine performance, other sensors can also be used with the present invention. While certain of the sensors have been shown schematically in FIG. 1, and were described with reference to that figure, it should be readily apparent to those of ordinary skill in the art that other types of sensing arrangements also can be provided for performing the same functions and/or different functions. Moreover, it is also possible to provide other sensors, such as an engine knock sensor, a watercraft pitch sensor, and an engine vibration sensor in accordance with various control strategies. Of course, the signals, while being depicted with wire connections, also can be transmitted using radio waves, infrared transmitter and receiver pairs, and other suitable or similar techniques.

The pressure dampening conduits 159 having certain features and advantages according to the present invention, will now be described in detail with reference to FIGS. 3–5B. As mentioned above, the pressure dampening conduits 159 preferably are used to connect the high pressure passage 162 of the high pressure pump 144 to the fuel rails 170*a,b*. The pressure dampening conduits 159 are connected to the fuel inlet and outlet module 157 by connectors 400, which are also used to connect the pressure dampening conduits 159 to the fuel rails 170*a,b*. The connects 400 are connected to the fuel inlet and outlet module 157 and to the fuel rail 170*a,b*, respectively, by bolts 402.

One aspect and advantage of the present invention is that the pressure dampening conduits 159 are elastic. That is, the pressure dampening conduits 159 can expand and contract as the pressure in within the pressure dampening conduit 159 fluctuates. As will be explained in more detail below, the expansion and contraction of the conduit 159 dampens the pressure fluctuations in the fuel lines by dissipating the energy of the pressure waves propagating through the fuel.

Figure 5A:
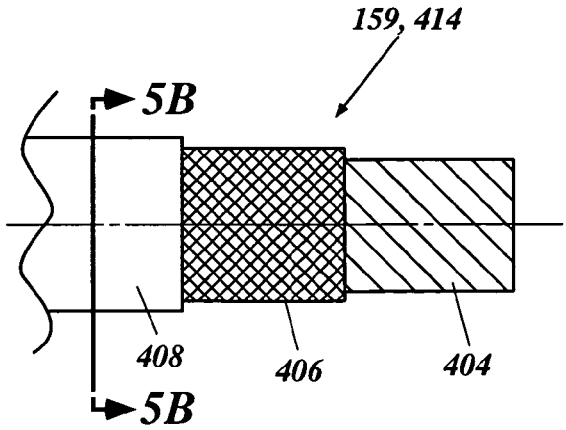
FIG. 5(A) is an enlarged view showing the layers of a flexible and elastic conduit that has certain features and advantages according to the present invention.
Figure 5B:
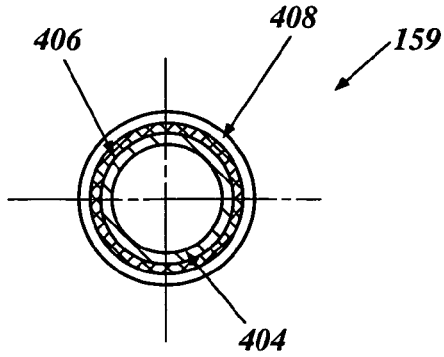
FIG. 5(B) is an enlarged cross-sectional view of the conduit of FIG. 5A taken along line 5B—5B.

FIGS. 5A and 5B illustrate a preferred construction of the pressure dampening conduits 159. Preferably, the pressure dampening conduits 159 are comprised of an inner layer 404, a middle layer 406 and an outer layer 408. The inner layer 404 preferably is made of elastomer-type of material such as a rubber walled resin material. The inner layer 404 preferably is also oil and gasoline proof. The middle layer 406 preferably limits the expansion of the pressure dampening conduits 159 and prevents bursts that can be caused by large pressure spikes. The middle layer 406 preferably also provides insulation. Accordingly, in the preferred arrangement, the middle layer is made of a fiber-based resin that is laminated to an outer periphery of the inner layer 404. Preferably, the middle layer 402 has a higher overall tensile strength than the inner layer 404. The outer layer 408 protects the middle and inner layers 406, 404. In the preferred arrangement, the outer layer is made of rubber and is laminated to an outer periphery of the middle layer 406. With reference to FIG. 3, the pressure dampening conduit 159 is preferably covered by a cover member 410 that is made of a flame retardant (incombustible) material, for example, a fireproofed rubber. Thus, the preferred pressure dampening conduits 159 are, as a whole, oil and gasoline proof and flame retardant as well as elastic (i.e., capable of expanding and contracting so as to dissipate pressure waves that propagate through the conduits 159).

The fuel injector supply system 164 preferably also includes a second pressure dampening conduit 414, which is preferably constructed as described above. The second pressure dampening conduit 414 can be connected to any portion of the fuel injector supply system 164. However, in the preferred arrangement, the pressure dampening conduit 414 is connected to a portion of the fuel injector supply system that is farthest from the pressure regulator 188. This position is preferred because this is where the pressure fluctuations tend to be the largest. More preferably, the pressure dampening conduit 414 is connected to the bottom end of the fuel rail 170. This arrangement is preferred because the bottom of the fuel rail 170 tends to reflect pressure fluctuations through the fuel injectors 114. Thus, as shown in FIGS. 3 and 4, one end of the pressure dampening conduit 414 is connected to the bottom of the fuel rail 170 by a connector 416 and the other end of the pressure dampening conduit 414 is closed with a plug 418.

Figure 6:
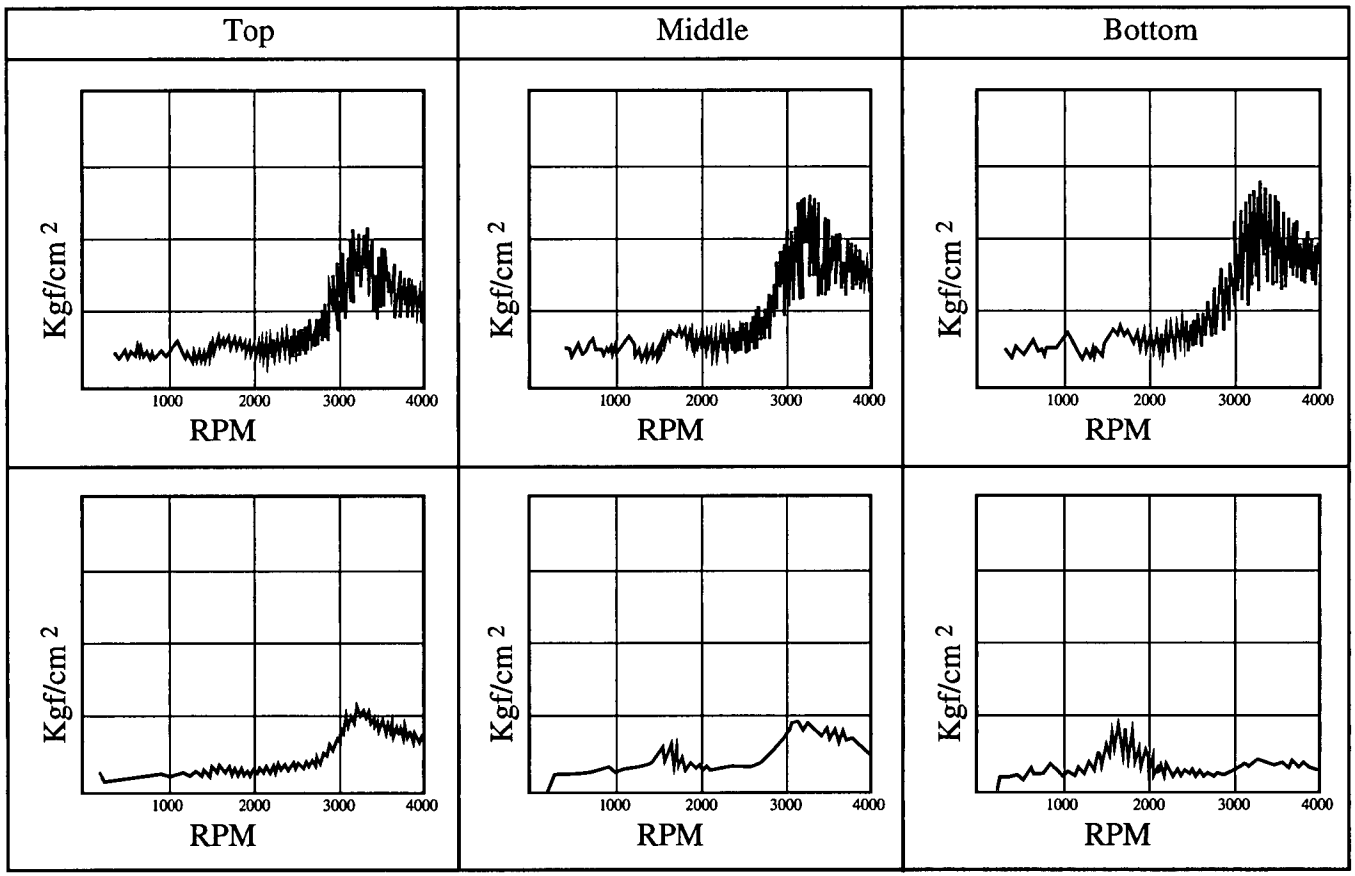
FIG. 6 is a series of graphs that illustrate fuel pressure at three in-line fuel injectors over a range of engines speeds. The top set of graphs represent the fuel pressure in an engine arranged according to the prior art and the bottom set represent the fuel pressure in an engine having certain features and advantages according to the present invention.

The addition of the pressure dampening conduits 159, 414 to the fuel injector supply system 164 dampens pressure fluctuations at the fuel injectors 114 as illustrated in the graphs of FIG. 6. These graphs illustrate fuel pressure at the fuel injectors 114 (the top, middle and bottom cylinders respectively) versus engine speed. The top row of graphs illustrate the pressure fluctuations at the fuel injectors in a fuel injector supply system arranged according to the prior art. As is evident for these graphs, the pressure fluctuations can be quite large especially at high engine speeds. Because fuel injection rate is calculated using the fuel pressure, these fluctuations make it difficult to control the air/fuel ratio.

The bottom row of graphs illustrate the pressure fluctuations in a fuel injector supply system 164 arranged as described above. It is evident from these graphs that the addition of the pressure dampening conduits 159, 414 reduces the pressure fluctuations at the fuel injectors 114. This reduction is caused by the dampening effect of the conduits 159, 414 as they dissipate energy as they expand and contract. As explained above, the air/fuel ratio is typically determined by calculating the fuel injector rate from the fuel pressure and the duration that the fuel injectors are open. By reducing the pressure fluctuations, the fuel injection rate can be more accurately determined. Accordingly, the fuel/air ratio can be controlled more precisely thereby reducing emissions and improving engine performance.

Although the fuel injector supply system 164 described above includes pressure dampening conduits 159, 414 located both between the high pressure fuel pump 144 and at the end of the fuel rail 170, several aspects and advantages of the present invention can be achieved with the pressure dampening conduits located at only one of those locations. The above described locations for the pressure dampening conduits 159, 414 are preferred but other locations can also be possible to effectively reduce pressure fluctuations without significantly increasing the complexity of the fuel injector supply system 164.

Figure 7:
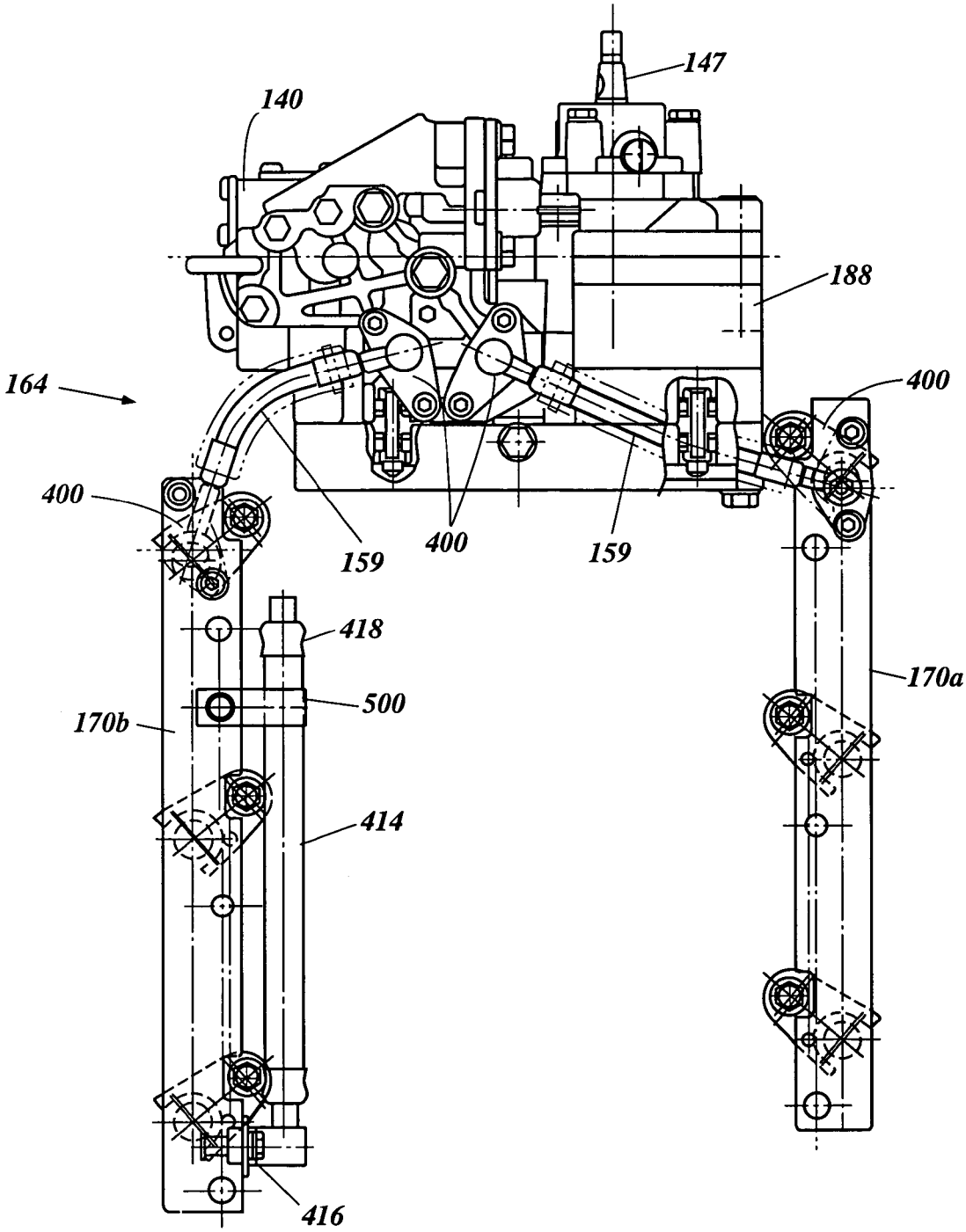
FIG. 7 is a rear elevational view taken generally in the direction indicated by arrow 3 in FIG. 2 showing a modified arrangement of a high pressure fuel injection assembly of the engine.

FIG. 7 illustrates a modified arrangement of the fuel injector supply system 164. In this arrangement, the second pressure dampening conduit 414 is secured to one of the fuel rails 170*b* by a fixture 500. This arrangement has the additional advantage of utilizing the space between the cylinder banks 75*a,b* for positioning the second pressure dampening conduit 414.

Figure 8:
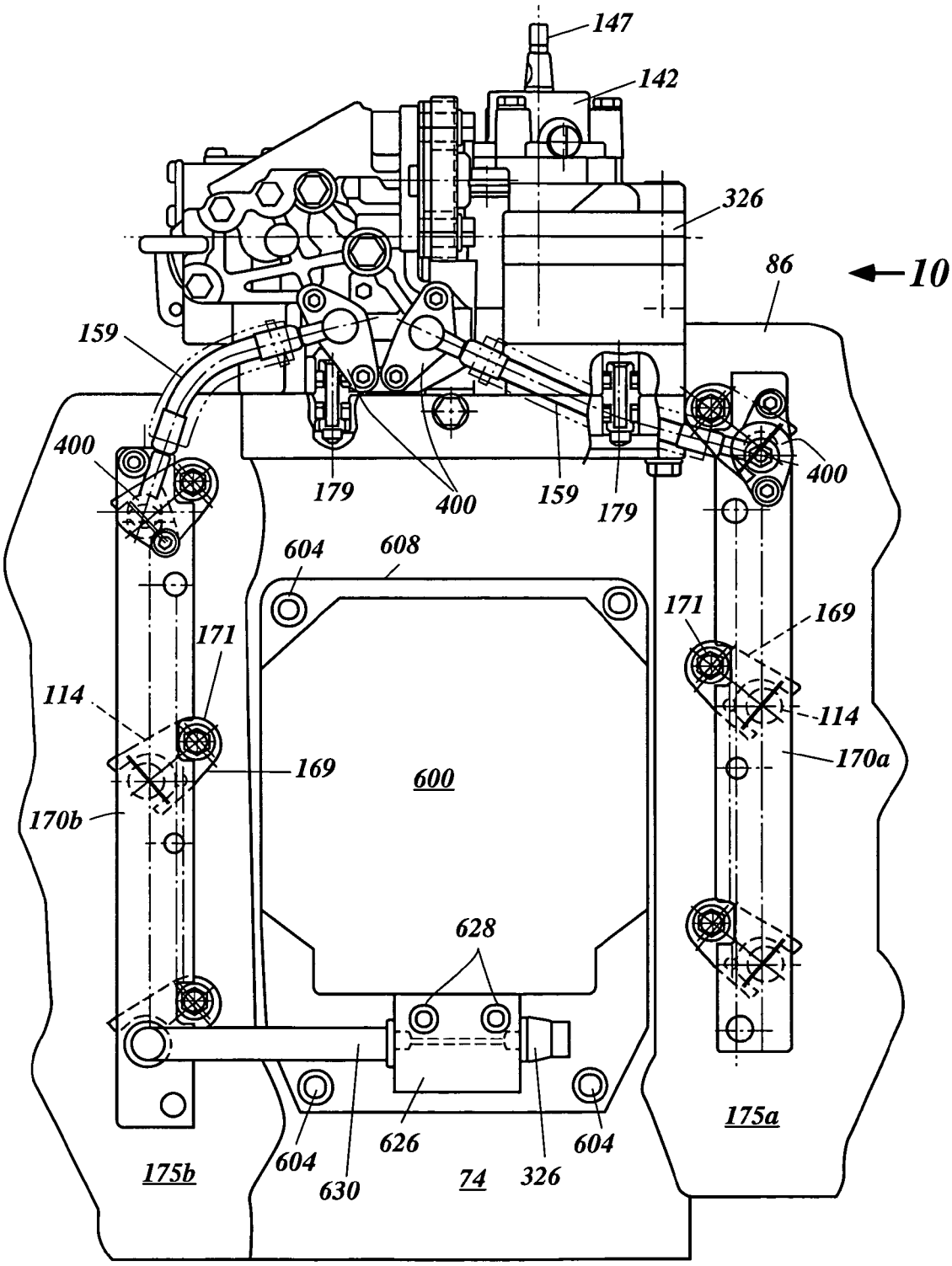
FIG. 8 is a rear elevational view of a modified arrangement of the engine of FIGS. 1 and 2 taken generally in the direction indicated by arrow 8 in FIG. 2.
Figure 9:
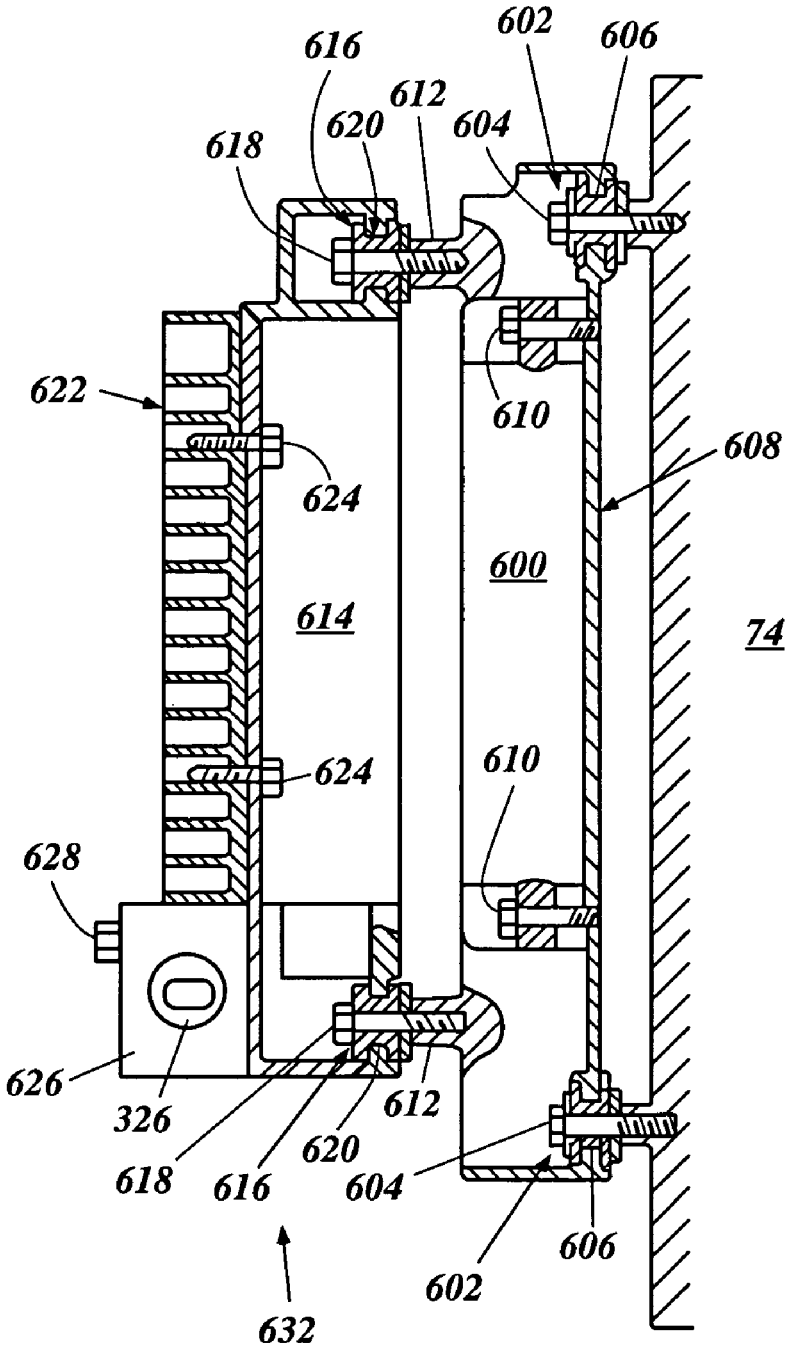
FIG. 9 is a partially sectioned side elevational view of an ECU and a fuel pressure sensor.

FIGS. 8 and 9 illustrate modified arrangement of the high pressure portion 118 of the fuel supply portion. Specifically, the location and arrangement of the pressure fuel pressure sensor 326 has certain features and advantages according to the present invention. FIG. 8 is rear elevational view similar to FIG. 3 showing the fuel injector supply system 164. FIG. 9 is a partially sectioned side elevational view of the ECU 108 and the fuel pressure sensor 326. Elements that are like the elements of other arrangements have been given the same reference numbers.

In this arrangement, the ECU 108 is desirably contained within an ECU mounting box 600. The ECU mounting box 600 preferably is secured to the cylinder block 74 through a plurality of resilient mounts 602. The resilient mounts 602 preferably are comprised of a bolt 604 and a first vibration dampening material 606, which is positioned between the bolt 604 and a mounting member 608 of the ECU mounting box 600. The first dampening material 606 is designed to reduce the amplitude of vibration transmitted from the engine 58 to the ECU mounting box 600. The first dampening material 606 may be manufactured from any suitable resilient material such as a soft rubber. The ECU 108, which is not shown in FIG. 9, preferably is secured to the mounting member 608 by a plurality of bolts 610.

With continued reference to FIG. 9, the ECU box 600 also preferably features a boss 612 on a side opposite the mounting member 608. An injector driver box injector driver box 614 is preferably attached to the ECU box 600 using a plurality of resilient mounts 616. The resilient mounts 616 are comprised of bolts 618 and a second vibration dampening material 620, which is positioned between the bolt 618 and the injector drive box 616. The bolts 616 extends into threaded holes formed in the boss 612.

The injector driver box 614 desirably houses an injector driver (not shown), which is configured to open and close the fuel injectors 114 in response to signals sent by the ECU 108. Advantageously, an array of heat transferring fins 622 (which are not shown in FIG. 8) may be attached to the injector driver box 616 by a set of threaded fasteners 624. The fins 622 advantageously increase the surface area of the box 614. In this manner, the heat transfer away from the box 614 may be increased. The size and configuration of the fins 622 can be optimized for maximum heat transfer in some embodiments.

The fuel pressure sensor 326 is housed within a fuel pressure sensor box 626. The fuel pressure sensor box 626 is secured to the injector driver box 614 by a set of threaded fasteners 628. The fuel pressure sensor 326 communicates with the fuel system through a high pressure fuel hose 630. Preferably, the fuel pressure sensor 326 is connected to the fuel system at a point between the fuel pressure pump 144 and the pressure regulator 188. More preferably, the fuel pressure sensor 326 is connected to the fuel system downstream of the fuel injectors 114. Accordingly, in the illustrated arrangement, the high pressure fuel hose 630 is connected to a lower portion of the fuel rail 170.

The combination of the ECU box 600 and the injector driver box 614 forms a vibration dampening/isolation structure 632 that protects the fuel pressure sensor 326 from damaged caused by the vibration of engine. In the preferred arrangement, the first and second damping materials 606 and 620 have different spring constants. More preferably, the first dampening material 606 is made of harder material than the second dampening material 620. Accordingly, the first dampening material 606 is designed to reduce the relatively high vibrations (e.g., 30 GHz) produced by the engine 58. The second dampening material 620 is designed to reduce the relatively lower vibrations (e.g., 8 GHz) that are transmitted through the ECU box 600. Accordingly, the vibrations at the fuel pressure sensor 326 are significantly reduced (e.g., 1 GHz).

Although in the illustrated arrangement the fuel pressure sensor 326 is secured to the injector driver box 614, the fuel pressure sensor 326 can also be directly attached through a vibration damping/isolation structure directly to the cylinder body 74. In such an arrangement, the fuel pressure sensor 326 is preferably isolated from the cylinder body 74 by one and more preferably two vibration damping materials as described above. The illustrated arrangement is preferred, however, because the same vibration damping/isolation structure 632 protects the fuel pressure sensor 326, the injector driver and the ECU 108.

Figure 10:
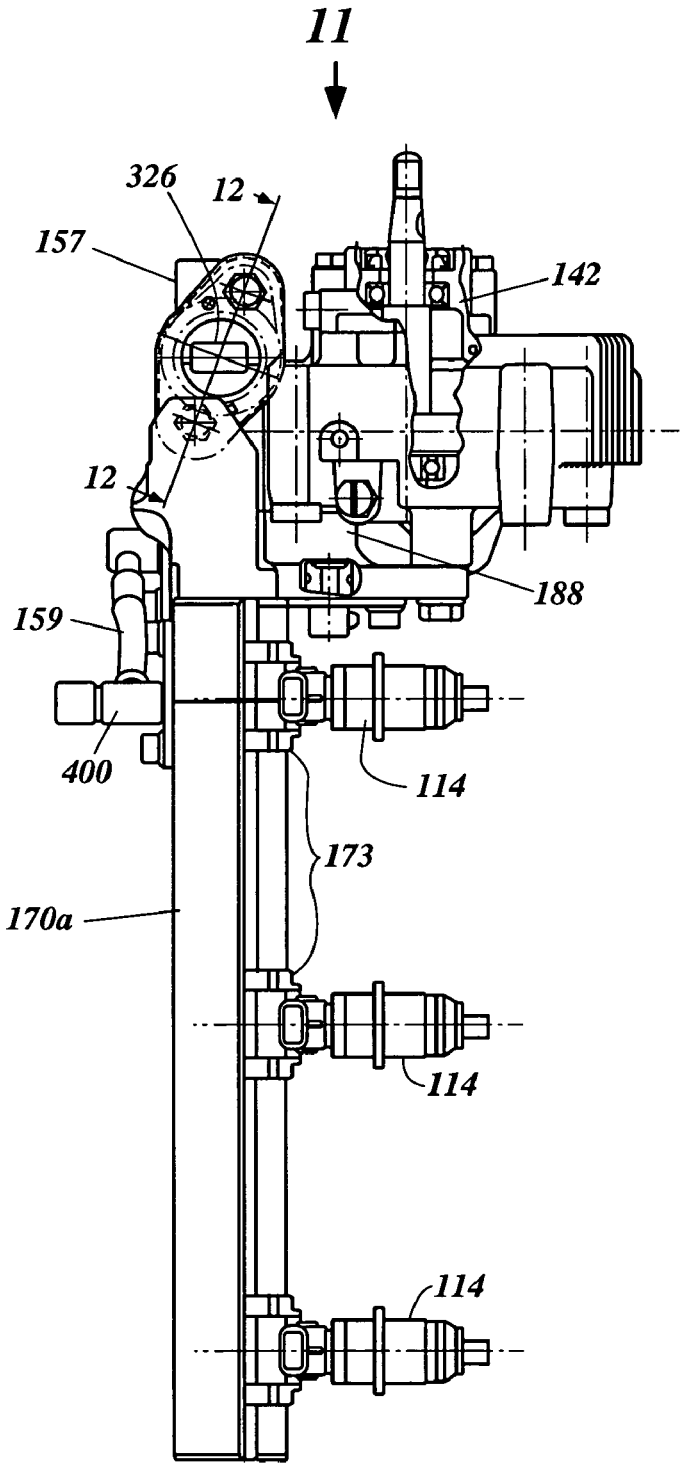
FIG. 10 a side elevational view of a modified arrangement of the high pressure fuel assembly taken generally in the direction indicated by arrow 10 in FIG. 8.
Figure 11:
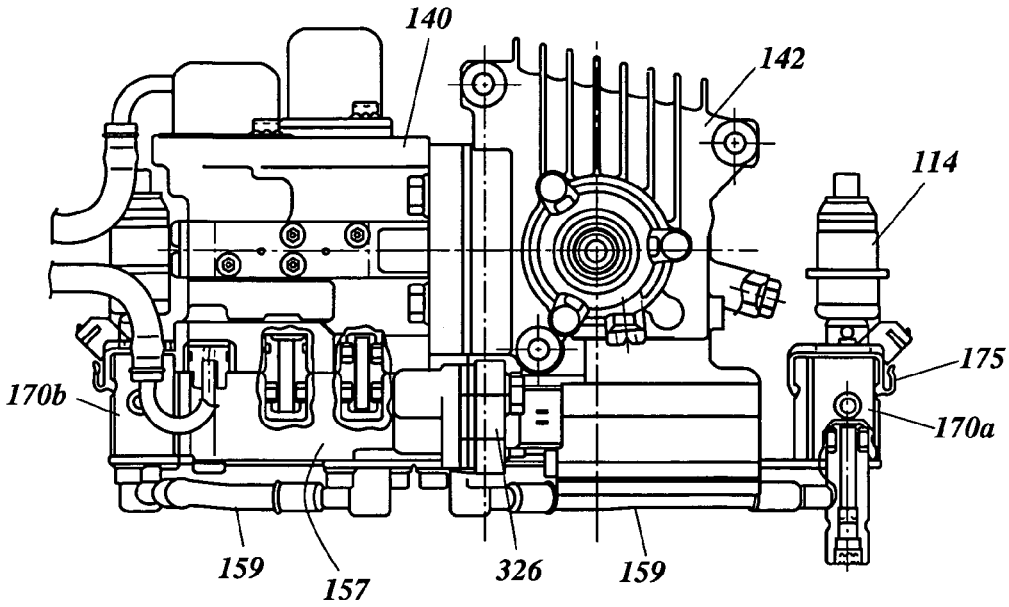
FIG. 11 is top plan view of the of the high pressure fuel injection system in the same arrangement as FIG. 10.
Figure 12:
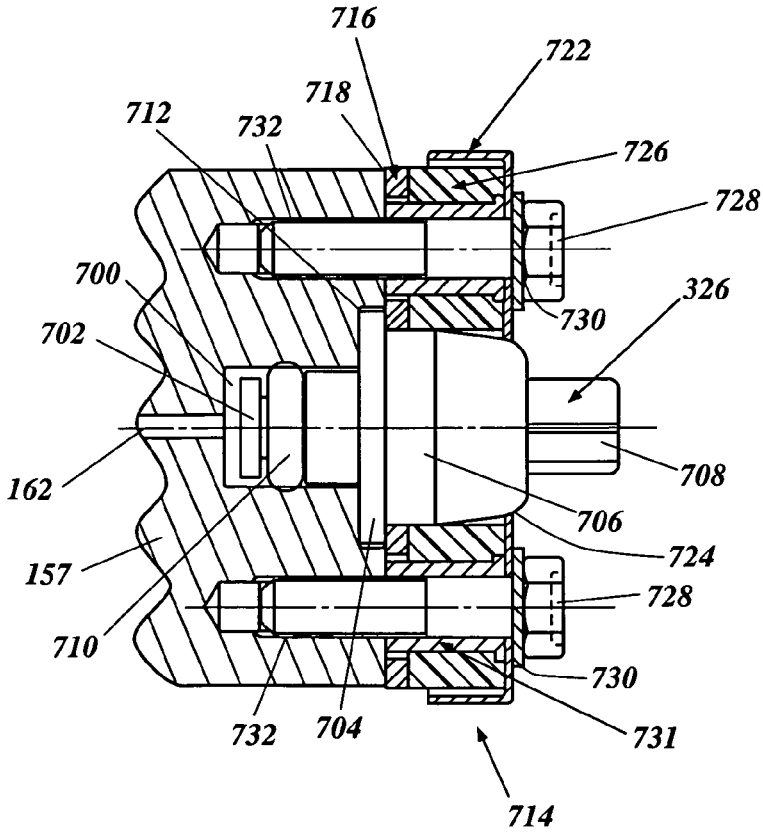
FIG. 12 is a partially cross-sectioned side elevational view of a fuel pressure sensor taken along line 12—12 of FIG. 11.

FIGS. 10–12 illustrate yet another modified arrangement of the high pressure portion 118 of the fuel supply portion. In this arrangement, the pressure fuel pressure sensor 326 can be located at any position between the high pressure fuel pump 144 and the pressure regulator 188. FIG. 10 is side elevational view of the high pressure portion 118 of the fuel supply system taken generally in the direction of arrow 10 of FIG. 8. FIG. 11 is a top plan view taken generally in the direction of arrow 11 in FIG. 10. FIG. 12 is a cross-sectional of the mounting arrangement taken along line 12—12 of FIG. 11. Elements that are like the components of other arrangements have been given the same reference numbers.

In this arrangement, the fuel pressure sensor 326 is secured to the fuel inlet and outlet module 157. Accordingly, as best seen in FIG. 12, a sensor insertion hole 700 is formed in the fuel inlet and outlet module 157. The sensor insertion hole 700 is preferably connected to the high pressure delivery passage 162 either before or after the outlet to the fuel rails 170.

The sensor 326 preferably includes a sensor portion 702, a flanged portion 704, a body portion 706 and a coupling portion 708. The sensor portion 702 preferably includes distortion gauges for sensing the pressure of the fuel which communicates with the sensor insertion hole 700. The fuel is prevented from escaping the insertion hole 700 by an O-ring 710 positioned around the sensor 326 and in the insertion hole 700. The flanged portion 704 preferably rests within a recess 712 that surrounds the insertion hole 700. The recess 712 and the flanged portion 704 prevent the sensor 326 from being pushed too far into the insertion hole 700, which would damage to the sensor portion 702.

The body portion 704 preferably houses circuits for amplifying and converting the pressure signals generated by the sensor portion 702. The information from the sensor 326 is preferably transferred to the ECU 108 through an electrical wire (not shown), which is preferably connected to the coupling portion 708.

To prevent damage to the sensor 326 caused by engine vibration, the sensor 326 is preferably provided with a vibration damping/isolation structure 714 having certain features and advantages according to the present invention. In the illustrated arrangement, the vibration damping/isolation structure 714 includes a mounting plate 716, which contacts a mounting surface 718 located on the fuel inlet and outlet module 157. The mounting plate 716 is preferably made of metal. The vibration damping/isolation structure 714 also includes a cover member 720. The cover member 722 includes an opening 724 through which the body portion 706 of the sensor 626 can pass.

A vibrational damping material 726 is disposed between the mounting plate 716 and the cover member 722. The vibrational damping material 726 is manufactured from any suitable resilient material, such as, for example a soft rubber. Bolts 728 and washers 730 secure the vibration damping/isolation structure 714 to the fuel inlet and outlet module 157. Specifically, the bolts 728 extend through openings in the cover member 720, the vibrational damping material 726, and the mounting plate 716 into threaded bolt holes 732 formed in the fuel inlet and outlet module 157. Collars 731 are positioned around the bolts 728 and prevent the bolts 728 from being inserted to far into the bolt holes 732.

The vibration damping/isolation structure 714 insulates the sensor 326 from the vibration caused by the engine 58 and that is transferred though the fuel inlet and outlet module 157. Specifically, as the fuel inlet and outlet module 157 vibrates, the vibration is absorbed by the vibrational damping material 726 as the mounting plate, which holds the sensor in place 326, vibrates back and forth. The vibration damping/isolation structure 714 therefore prevents the sensor 326 from being damaged when it is mounted directly to the fuel inlet and outlet module 157. This results in more accurate readings of the fuel pressure and the derived fuel/air ratio. This arrangement also prolongs the life of the pressure sensor 326.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combination or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A direct fuel injected system for an internal combustion engine having at least one combustion chamber, comprising a high pressure fuel pump for developing high pressure fuel, a fuel injector to directly inject fuel into the combustion chamber of said engine, a pressure regulator to regulate fuel pressure within the fuel system, and a fuel pressure sensor for sensing a fuel pressure of the fuel, said fuel pressure sensor being secured to said engine through a vibration damping apparatus, wherein said vibration damping apparatus includes a first and a second dampening material, said first dampening material being stiffer than the second dampening material.

2. A direct fuel injected system as set forth in claim 1, wherein said fuel pressure sensor is positioned between said fuel pump and said pressure regulator.

3. A direct fuel injected system for an internal combustion engine having at least one combustion chamber, comprising a high pressure fuel pump for developing high pressure fuel, a fuel injector to directly inject fuel into the combustion chamber of said engine, a pressure regulator to regulate fuel pressure within the fuel system, and a fuel pressure sensor for sensing a fuel pressure of the fuel, said fuel pressure sensor being secured to said engine through a vibration damping apparatus, wherein said vibration dampening apparatus includes an electronic control box for housing an electronic control unit.

4. A direct fuel injected system as set forth in claim 3, wherein said fuel system further includes a fuel rail that supplies fuel to said fuel injector and said fuel pressure sensor is connected to said fuel rail downstream of said fuel injector.

5. A direct fuel injected system as set forth in claim 3, wherein said vibration damping apparatus includes dampening materials.

6. A direct fuel injected system as set forth in claim 3, wherein said vibration dampening apparatus further includes a fuel injector driver box for housing an injector control unit.

7. A direct fuel injected system as set forth in claim 6, wherein said pressure sensor is mounted onto said fuel injector driver box.

8. A direct fuel injected system as set forth in claim 7, wherein said electronic control box is mounted on said engine and is insulated from engine vibrations by a first dampening material.

9. A direct fuel injected system as set forth in claim 8, wherein said fuel injector driver box is mounted on said electronic control box and is insulated from the vibration of the electronic control box by a second dampening material.

10. A direct fuel injected system as set forth in claim 9, wherein said first dampening material is stiffer than the second dampening material.

11. A direct fuel injected system for an internal combustion engine comprising a high pressure fuel pump for developing high pressure fuel, a fuel injector to directly inject fuel into a combustion chamber of said engine, a fuel pressure sensor that communicates with said fuel system for measuring a fuel pressure within said fuel system, the fuel pressure sensor being mounted on an electronic control box for housing an electronic control unit and means for protecting the fuel pressure sensor from damage caused by engine vibrations.

12. A direct fuel injected system for an internal combustion engine having at least one combustion chamber, comprising a high pressure fuel pump for developing high pressure fuel, a fuel injector to directly inject fuel into the combustion chamber of said engine, the fuel injector receiving high pressure fuel from the fuel pump, and a pressure dampening device in communication with the fuel injector, wherein said pressure dampening device comprises an elastic conduit having at least one elastic wall exposed to said high pressure fuel without intervening structures, wherein said elastic conduit comprises an inner member that is made of an elastic material, a middle member made of a material having greater tensile strength than the inner material, and an outer protective member.

13. A direct fuel injected system as set forth in claim 12, wherein said inner member is made of a rubber.

14. A direct fuel injected system as set forth in claim 13, wherein said middle member is made of a resin fiber material.

15. A direct fuel injected system as set forth in claim 14, wherein said outer protective member is made of rubber.

16. A direct fuel injected system as set forth in claim 12, wherein said fuel system further includes a fuel rail that supplies fuel to said fuel injector and said elastic conduit device supplies fuel to said fuel rail.

17. A direct fuel injected system for an internal combustion engine having at least one combustion chamber, comprising a high pressure fuel pump for developing high pressure fuel, a fuel injector to directly inject fuel into the combustion chamber of said engine, the fuel injector receiving high pressure fuel from the fuel pump, and a pressure dampening device in communication with the fuel injector, wherein said pressure dampening device comprises an elastic conduit having at least one elastic wall exposed to said high pressure fuel without intervening structures, wherein said fuel system further includes a fuel rail that supplies fuel to said fuel injector and said pressure dampening device is connected to an end of said fuel rail downstream of said fuel injector.

18. A direct fuel injected system as set forth in claim 17, wherein said pressure dampening device is an elastic conduit with a plugged end.

19. A direct fuel injected system for an internal combustion engine having at least one combustion chamber, comprising a high pressure fuel pump for developing high pressure fuel, a fuel injector to directly inject fuel into the combustion chamber of said engine, the fuel injector receiving high pressure fuel from the fuel pump, and a pressure dampening device in communication with the fuel injector, wherein said pressure dampening device comprises an elastic conduit having at least one elastic wall exposed to said high pressure fuel without intervening structures, wherein said engine is enclosed within a protective cowling and includes a vertically disposed crank shaft and two banks of cylinders in a V-type configuration, said fuel system further including a fuel rail that is secured to a cylinder head of each bank of cylinders and said pressure dampening device is connected to at least one end of the fuel rail.

20. A direct fuel injected system as set forth in claim 19, wherein the pressure dampening device is connected to a lower end of the fuel rail.

21. A direct fuel injected system as set forth in claim 20, wherein the pressure dampening device is an elastic conduit plugged at one end.

* * * * *